US005240347A

United States Patent [19]

Williams et al.

[11] Patent Number: 5,240,347

[45] Date of Patent: Aug. 31, 1993

[54] COLLAPSIBLE BOAT LIFT

[75] Inventors: David A. Williams; Jay Ehrsam, both of Angola, Ind.

[73] Assignee: Shorethings, Inc., Angola, Ind.

[21] Appl. No.: 986,984

[22] Filed: Dec. 8, 1992

[51] Int. Cl.[5] ..... B63C 3/12

[52] U.S. Cl. ..... 405/3; 114/48

[58] Field of Search ..... 405/1, 3, 4, 7; 114/44, 114/45, 48; 414/678

[56] References Cited

U.S. PATENT DOCUMENTS

| | | | |
|---|---|---|---|
| 2,505,832 | 5/1950 | Lange | 61/65 |
| 3,260,377 | 7/1966 | Vilter | 405/3 X |
| 3,579,996 | 5/1971 | Edson | 405/1 |
| 4,027,492 | 6/1977 | Carpenter | 61/65 |
| 4,037,421 | 7/1977 | Whitley, Jr. | 61/65 |
| 4,595,313 | 6/1986 | Kotke | 405/2 |
| 4,641,996 | 2/1987 | Seal | 405/2 |
| 4,773,346 | 9/1988 | Blanding | 114/45 |
| 4,787,327 | 11/1988 | Porter | 114/44 |
| 4,832,210 | 5/1989 | Wood, II | 212/200 |
| 4,895,479 | 6/1990 | Michaelsen | 405/3 |
| 4,944,633 | 7/1990 | Robb | 405/3 |
| 4,954,011 | 9/1990 | Stenson | 405/3 |

*Primary Examiner*—David H. Corbin

*Attorney, Agent, or Firm*—Baker & Daniels

[57] ABSTRACT

A boat lift that is collapsible into a plurality of segments for quick and convenient transportation and storage during the off-season. The boat lift comprises a frame and a boat-engaging carriage that is movable on the frame between an elevated position and a lowered position. The frame forms an inclined track upon which the carriage traverses and comprises two spaced siderails, and a front and rear brace member. The front brace member comprises two segments that are each pivotally attached to a respective siderail. The segments are selectively removable from one another to permit the segments to be folded back adjacent their respective siderails. The rear brace member is selectively removable from the siderails so that the frame member may be collapsed into three separate segments. The carriage is removable from the frame and may be collapsed in a similar manner.

4 Claims, 5 Drawing Sheets

COLLAPSIBLE BOAT LIFT

BACKGROUND OF THE INVENTION

The present invention relates generally to boat lifts for elevating boats out of the water when not in use and, more particularly, to a readily transportable boat lift.

Boat lifts are well known in the art for raising a boat, sailboat, jet ski, pontoon boat, or other small watercraft out of the water to protect it from the surf, algae, sea animals, etc. Most known boat lift devices employ cables for raising and lowering the hoistable carriage. One such boat lift is described in U.S. Pat. No. 4,595,313, wherein the lift includes an inclined track assembly having a lower end fastened adjacent a rearward frame part and an upper end fastened near the forward frame part. The inclined track assembly includes tracks that are deployed at an angle between about 10° to 45° from a horizontal. The boat platform is mounted for movement on the track.

Another boat lift design is disclosed in U.S. Pat. No. 4,027,492. This boat lift includes a flotation system to provide a buoyant support during transportation of the boat lift in the water to and from a desired anchorage. The flotation system includes flotation devices that are attached to the framework via a second cable system. After the boat lift has been manually positioned in a desired location, a take-up device is operated to permit gravity induced lowering of the base portion into engagement with the bottom of the body of water. Thereafter, the float devices are removed, and the lift is permitted to reside in its normal rest or inoperative condition. At the completion of the boating season, the boat lift is raised and transported to a suitable on-shore storage area by first attaching floating devices to the submerged lift which are then employed to raise the lift into its transport condition.

Although boat lifts, such as those described above, are manufactured in a wide variety of designs for raising an lowering a boat, they generally have one common drawback. They are very difficult and often expensive to remove and store for the off-season, which is necessary in colder climates in order to protect them from damage caused by ice and other harsh winter conditions. Although the boat lift described in the U.S. Pat. No. '492 patent may aid the user in transporting the lift while the lift is in the water, it is still very cumbersome to transport and store once the lift has been moved from the water onto land.

It is desired to provide a boat lift which is less cumbersome and easily storable on land.

SUMMARY OF THE INVENTION

The present invention provides a boat lift of such a construction which enables an easy and quick teardown, storage, and setup by comprising a movable carriage supported on a frame, wherein the carriage is removable from the frame and collapsible into various sections, and wherein the frame itself is also collapsible into various smaller sections to facilitate easier transportation and storage.

Generally, the present invention provides a boat lift having a rigid frame comprising two spaced siderail members and a connector extending between the rail members for establishing a desired distance between the rail members. The lift further includes a carriage for supporting a boat, wherein the carriage is removably supported on the frame and movable thereon between a lowered position and an elevated position. The boat lift is selectively convertible between a disassembled state for transportation and storage, wherein the carriage and each of the rail members are detached from another, and an assembled state for use, wherein the carriage and each rail member are attached to one another.

More specifically, the present invention provides, in one form thereof, a boat lift having a frame comprising two siderails and two connectors therebetween, a front brace member and a rear brace member. The front brace member comprises two segments, each segment being pivotally attached to its respective siderail member. The two segments are secured to one another by a removable joint. The rear brace member comprises a single elongate rail having opposite ends that are each removably secured to a respective siderail Upon disassembling the frame, the front brace segments are disconnected from one another and are each pivotally folded back to be generally parallel with their respective siderails. The rear brace member is disconnected from the siderail at its respective end joints and removed from the siderails to form a separate frame segment Accordingly, the frame is collapsed into three frame segments.

The present invention, in one form thereof, further comprises a carriage that is movably supported on the frame described above. The carriage comprises a carriage frame that is either slidable or rollable about the boat lift frame and has a front frame member, a rear frame member, and a boat-engaging portion extending between the front and rear frame members. The ends of the boat-engaging portion are removably secured to the respective frame members so that, upon disassembly, the carriage is disassembled into three separate components, namely the front and rear frame members and the boat-engaging portion. The invention may further include additional detachable carriage components as desired or necessary.

An advantage of the boat lift of the present invention is that it is collapsible into a plurality of segments for easy transportation of the boat lift on land.

Another advantage of the boat lift of the present invention is that it may be stored in a compact area, such as a home or a small storage shed.

Yet another advantage of the boat lift of the present invention is that it may be quickly and securely assembled for use.

Other advantages of the present invention will become apparent from the following description.

DETAILED DESCRIPTION OF THE INVENTION

Figure 1:
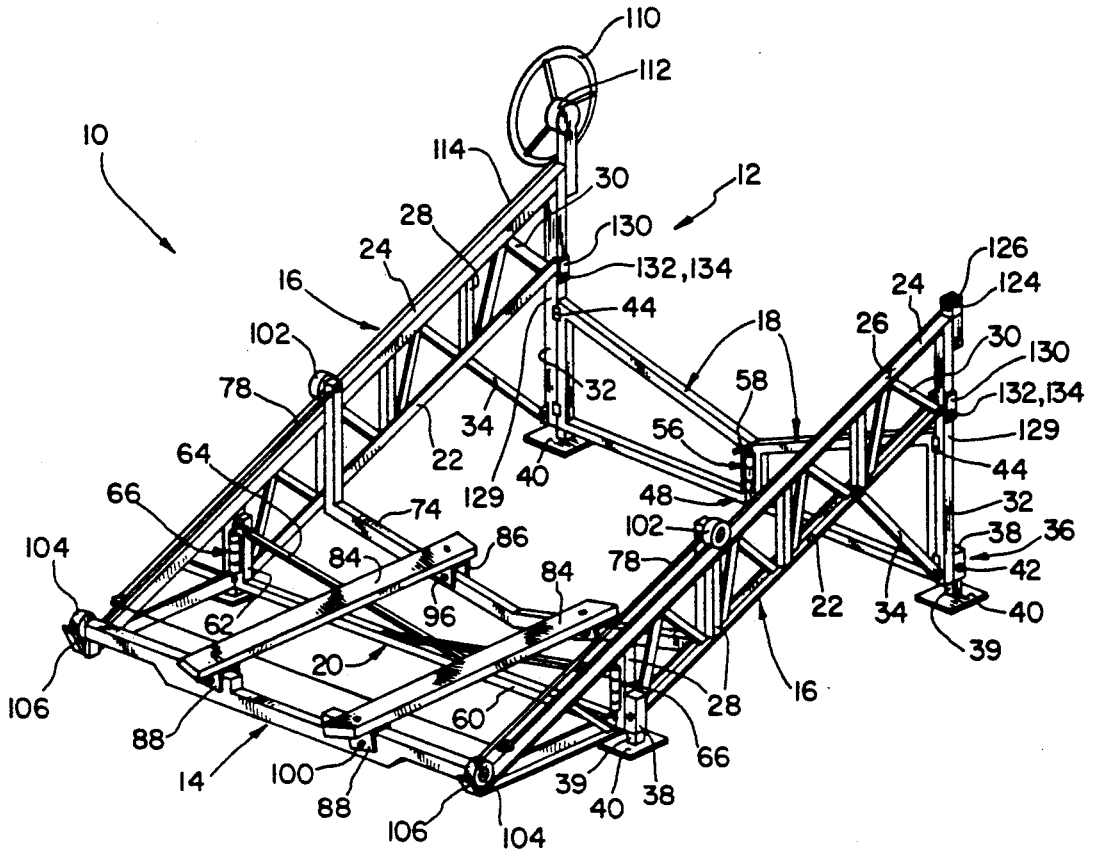
FIG. 1 is a perspective view of a boat lift in accordance with of the present invention.
Figure 2:
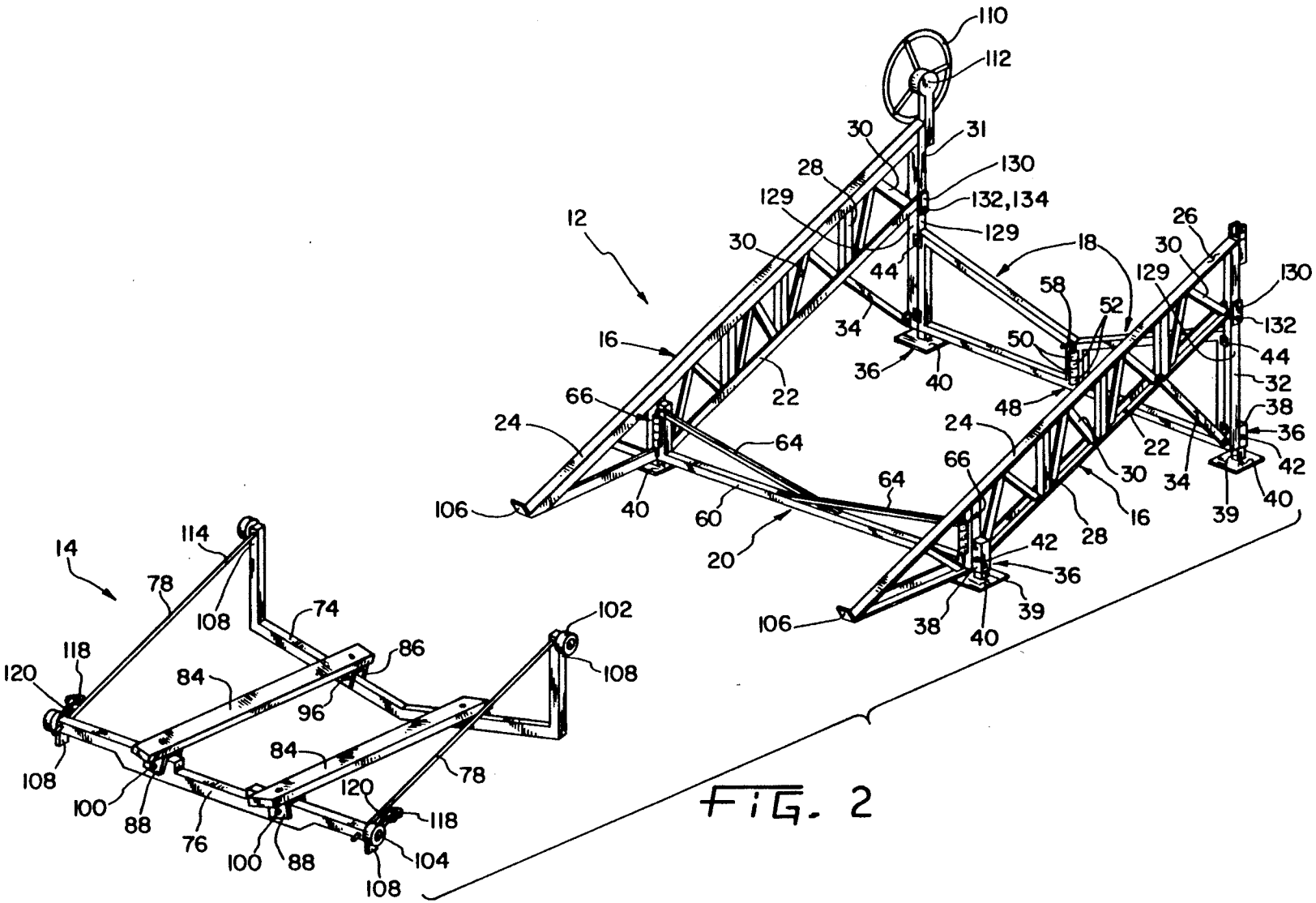
FIG. 2 is a view of the boat lift of FIG. 1, wherein the carriage is shown detached from the frame.

Referring now to the drawings, and in particular to FIGS. 1 and 2, there is shown a collapsible boat lift 10 in accordance with principles of the present invention. Lift 10 generally comprises a frame 12, preferably made of aluminum, and a movable carriage 14, also preferably made of aluminum, for supporting a boat in a raised or elevated position. Frame 12 generally comprises siderail members 16, a front brace member 18 and a rear brace member 20. Each siderail member comprises a lower rail 22 and an upper rail 24 including a track surface 26. Vertical braces 28 and angled stiffening braces 30 are provided for reinforcing rail members 16.

Figure 8:
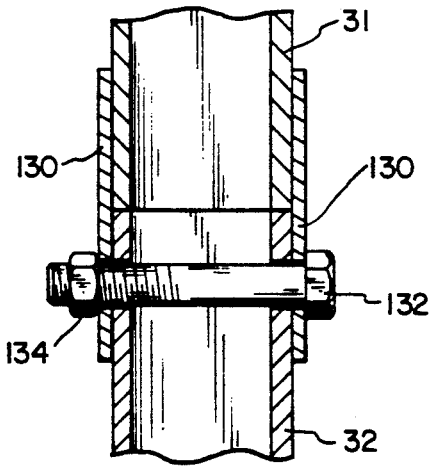
FIG. 8 is a sectional view of one of the upper and lower support posts connected to one another.
Figure 7:
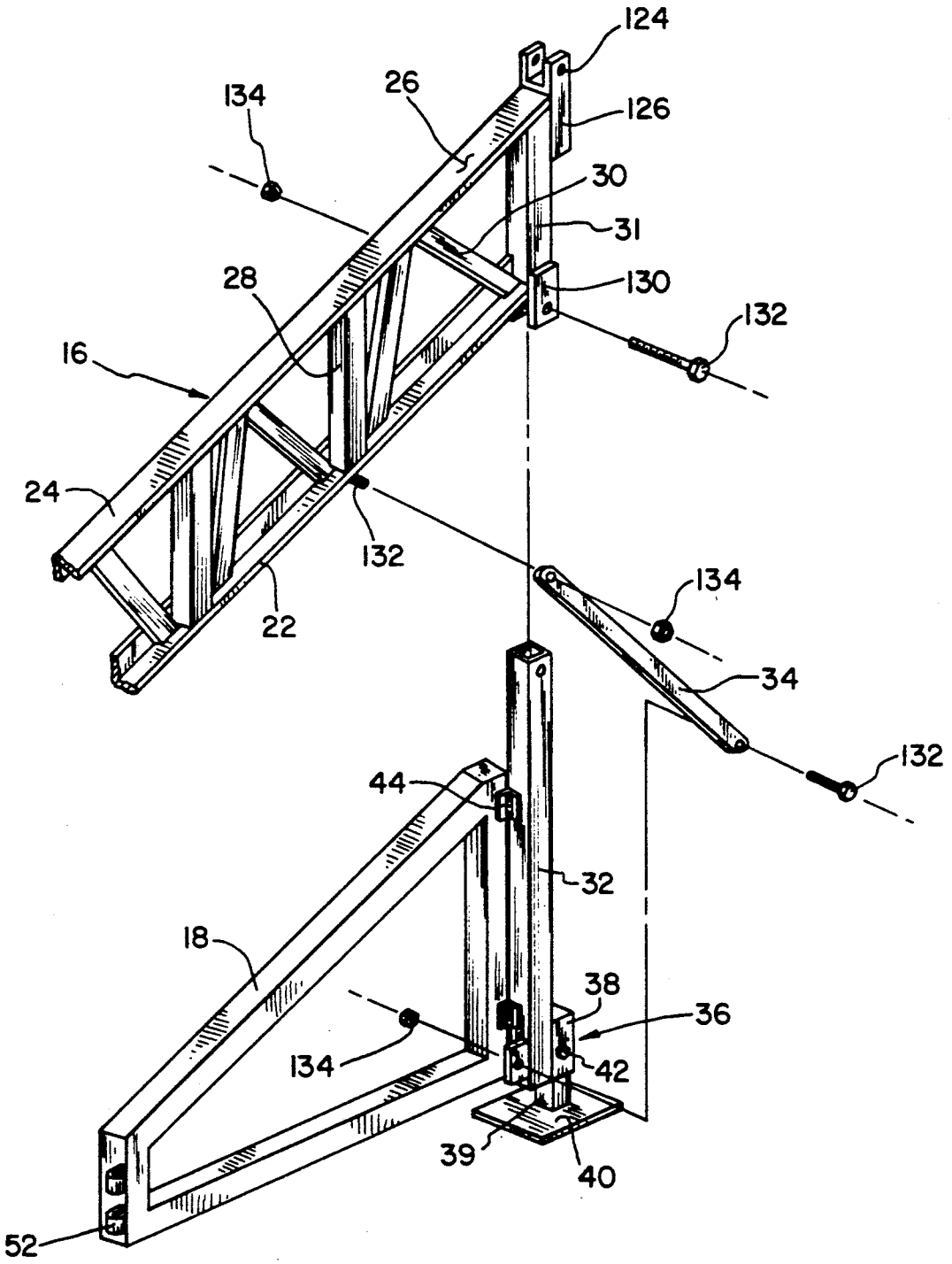
FIG. 7 is an enlarged exploded perspective view of an upper and lower support post at the forward end of the boat lift.

The forward end of each siderail member 16 is supported by an upper post 31 and a lower post 32. As best shown in FIG. 8, a gusset plate 130 is Welded to each side of upper post 31. In order to secure upper post 31 to lower post 32, a threaded bolt is inserted into aligned openings in plate 130 and lower post 32, and a nut 134 is provided to secure bolt 132 therein. As best shown in FIG. 7, an inclined stabilizing brace 34 is provided on each side of the boat lift and extends between lower rail 22 and lower support post 32. Brace 34 is removably secured to both lower rail 22 and lower support post 32 by another bolt 132 and nut 134 combination.

There are no support posts at the rearward ends of siderail members 16 to cause siderail members 16 to be angled as shown in the drawings Each siderail member 16 further includes two support assemblies 36, each comprising a base portion 38, a support pad 40, and an adjustable leg 39 that is held in place by pin 42.

Front brace member 18 is secured to siderail members 16 by pivot hinges 44 as shown. Front brace member 18 comprises two separate members which are removably secured to one another at a butt hinge 48 (FIG. 2). Hinge 48 comprises knuckles 50 and 52 attached to the respective ends 54 of front brace members 18 (FIG. 4) such that as the ends are place adjacent one another, a sleeve is formed, through which an L-shaped pin 58 is inserted.

Figure 4:
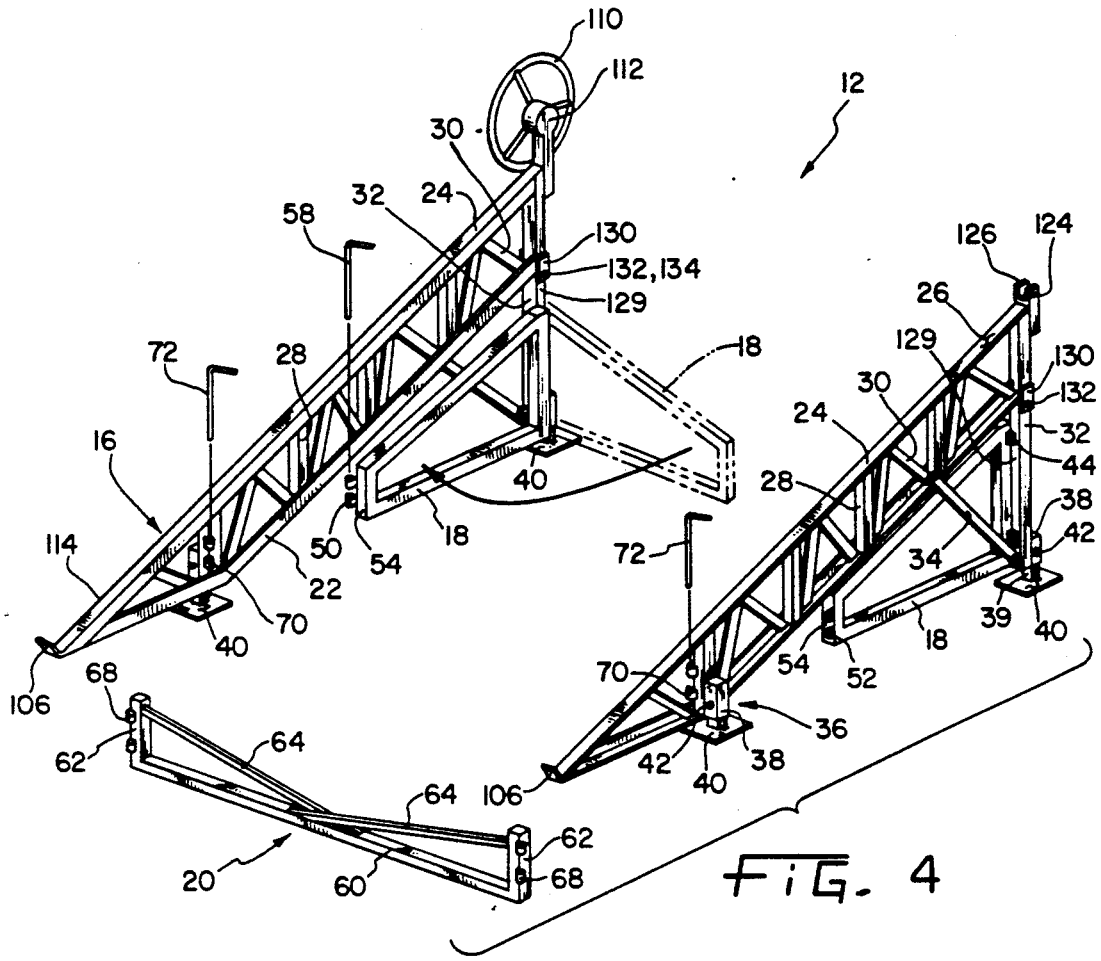
FIG. 4 is a view of the frame of FIG. 2, particularly showing the frame being disassembled.

Referring to FIG. 4, rear brace member 20 comprises a U-shaped rail having a base 60 and side members 62. Inclined supporting posts 64 extend from respective side members 62 to base 60 in order to strengthen and reinforce rear brace 20. Brace 20 is secured to siderail members 16 at joints 66 (FIGS. 1, 2). In particular, side members 62 of rear brace member 20 include knuckles 68 which interconnect with knuckles 70 (FIG. 4) on the rearward most vertical brace 28 of siderail members 26 to form a sleeve through which an L-shaped pen 72 extends.

Figure 3:
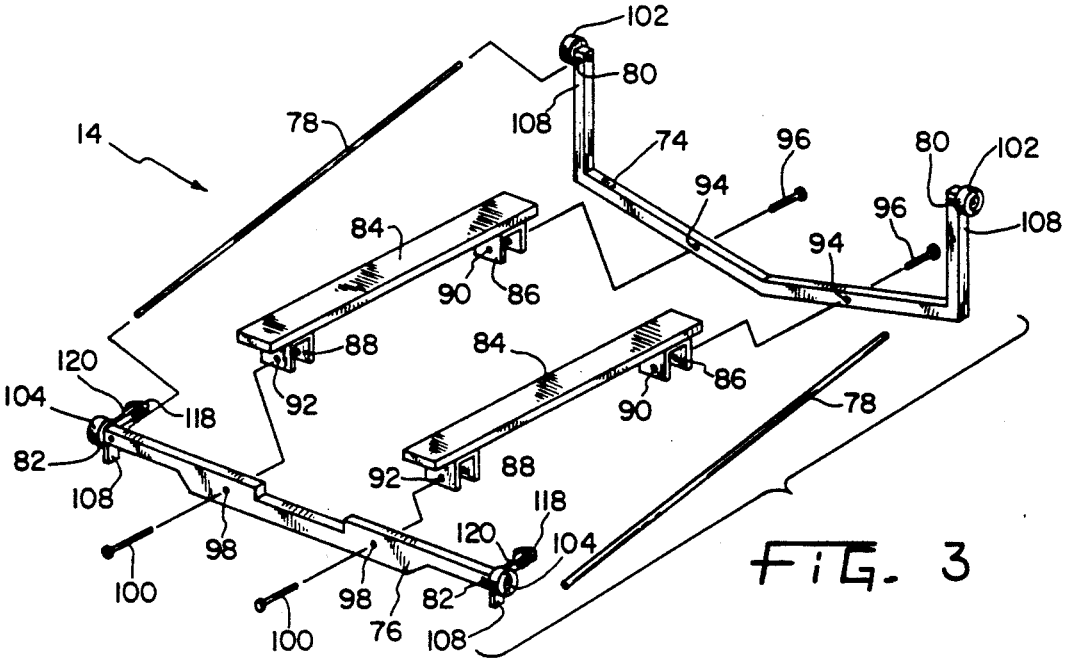
FIG. 3 is an enlarged exploded view of the carriage of FIG. 2, particularly showing the various components that make up the carriage.

As best shown in FIG. 3, carriage 14 comprises a forward generally U-shaped forward member 74 and a rearward elongate member 76. The forward member 74 is connected to rearward member 76 by rods 78 that extend through openings 80 and 82 in forward member 74 and rearward member 76, respectively. A pair of lift supports 84, preferably made of wood or other suitable material, are provided, and each includes a forward U-shaped mounting bracket 86 and a rearward U-shaped mounting bracket 88. Brackets 86 and 88 include openings 90 and 92, respectively, therethrough. The front end of each lift support 84 is secured to forward member 74 by aligning openings 90 in mounting bracket 86 with an opening 94 in forward member 74 and inserting a straight pin 96 therethrough. Likewise, openings 92 in each rearward bracket 88 are aligned with an opening 98 in rearward member 76, and then a straight pin 100 is inserted therethrough.

Carriage 14 includes rollers 102, 104 which move up and down the angled track surface 26 of frame 12. In particular, rollers 102 are mounted on the upstanding ends of U-shaped member 74, and rollers 104 are mounted on the ends of rearward member 76. When installed on track surface 26 of frame 12, rollers 104 are retained at the bottom of track 26 by stops 106. Rub blocks 108, preferably constructed of a polyethylene material, are provided to prevent metal-to-metal contact between members 74, 76 and upper rails 24 of rail members 16.

Figure 5:
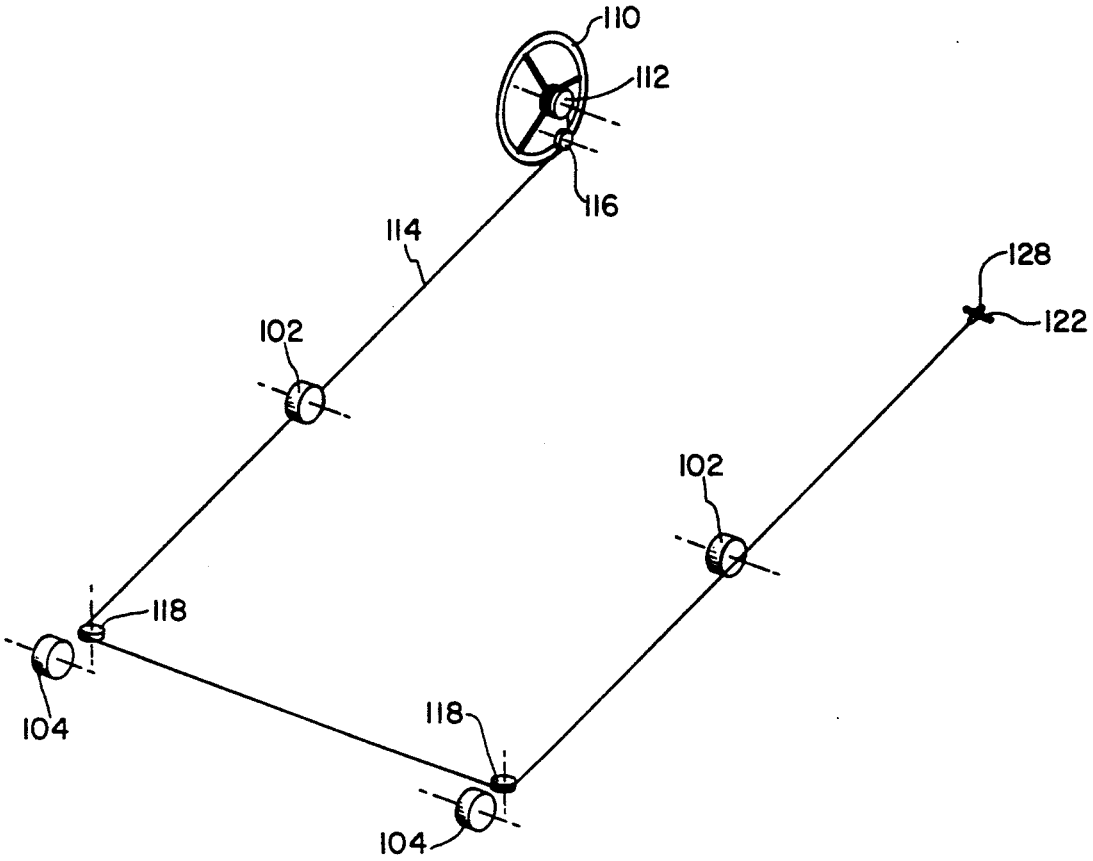
FIG. 5 is a schematic view showing details of the lifting cable path through the frame.

Carriage 14 is drawn up the inclined track surface 26 by a cable and pulley system as best shown in FIG. 5. In particular, a manually actuable wheel 110 is attached to the top of one of the support posts 32 and includes a winch 112 for winding a cable 114 thereabout. Wheel 110 may be attached to either of the support posts 32 Cable 114 passes over an upper guide pulley 116 and two lower guide pulleys 118 that are secured to carriage rollers 104 by a bracket 120, as shown in FIGS. 2 and 3. One end of cable 114 is secured to a "quick disconnect" pin 122 that extends through openings 124 in U-shaped assembly 126 at the top of one of the support posts 32 (FIG. 1). In use, carriage 14 is moved upwardly along track surface 26 by cable 114 as the cable is wound about winch 112. Conversely, carriage 14 is lowered as cable 114 is wound in the opposite direction. Although a manual cable/pulley mechanism is shown, other carriage lifting mechanisms are possible, such as electric-driven motor mechanism and a hydraulic-driven motor mechanism.

In order to disassemble boat lift 10, carriage 14 is lifted off of frame 12. The carriage may then be disassembled. Pins 96 and 100 are removed from their respective openings to permit lift supports 84 to be removed from forward 74 and rearward 76 members. Thereafter, rods 78 may be removed from forward 74 and rearward 76 members. Finally, the pulley 118 and bracket 120 assembly may be removed from the ends of rearward member 76 by removing the "quick disconnect" pins (not shown).

Referring now to frame 12, L-shaped pin 58 and the two L-shaped pins 72 are lifted out of their respective sleeves. Removal of L-shaped pin 58 permits frame members 46 to be manually pivoted about their respective pivot hinges 44 toward respective rail members 16 until each is substantially parallel to its respective rail member 16. Removal of L-shaped pins 72 permits rear brace member 20 to be removed from siderail members 16. Accordingly, frame member 12 breaks down into three separate sections, namely two siderail assemblies (each including a folded front brace member 18) and a separate rear brace member 20. Each of the separate sections are preferably sized and configured to permit them to pass through an average size door to enable the sections to be stored in a home or a home storage building. In addition, the sections are lightweight to permit removal of any section by two average-sized persons.

If desired, each siderail assembly may be further disassembled by removing bolts 132 from stabilizing brace 3 and removing the remaining bolt 132 from gusset plates 130. Thus, in this instance, each siderail assembly may be disassembled into three segments, namely a front brace member and lower support post 32, a stabilizing brace 34, and a siderail member 16 and upper support post 31. It is noted that each siderail assembly does not need to be disassembled in order to transport the boat lift; however, it may be desirable to disassemble each siderail assembly for more compact storage.

Figure 6:
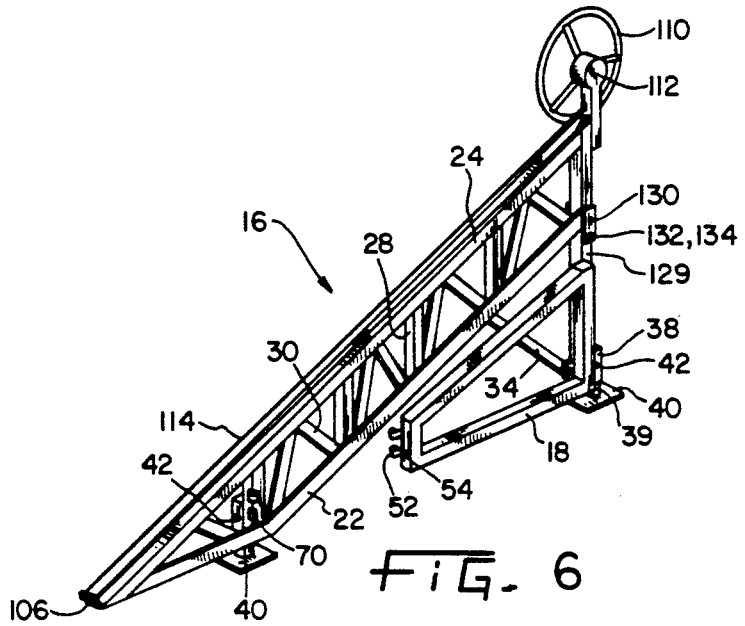
FIG. 6 is a perspective view of a single segment of the frame shown in FIG. 2.

The cable 114 may be stored as shown in FIG. 6. Particularly, loop 128 may be threaded through a slot (not shown) on the bottom surface of stop 106 and secured within a slot (not shown) at the top of post 31.

The boat lift may be assembled by reversing the above steps. Thus, the present invention provides a boat lift that facilitates an easy and quick method of teardown, storage, and setup. Although specific types of hinges and joints have been described herein, other removable hinges or joints, or other removable attaching devices, such as hasps, may be utilized. In addition, it will be appreciated that front brace member 18 may be removably secured to siderail members 16, if desired, to form another separate segment upon disassembly of the boat lift. Furthermore, although the boat lift described above employs an inclined track, it will be appreciated that other boat lift configurations are possible.

It will be appreciated if the foregoing is presented by way of illustration only, and not by way of any limitation, and that various alternatives and modifications may be made to the illustrated embodiment without departing from the spirit and scope of the invention.

What is claimed is:

1. A collapsible boat lift, comprising:

a rigid frame having two spaced siderail members and a connector extending between said rail members for establishing a desired distance between said rail members;

a carriage for supporting a boat, said carriage being removably mounted on said frame and being movable thereon between a lowered position and an elevated position; and means for converting said frame between a disassembled state for transportation and storage wherein said carriage and each said rail member are detached from one another, and an assembled state for use, wherein said carriage and each said rail member are attached to one another;

wherein said connector comprises a fist segment having a first inner end and a first outer end and a separate second segment having a second inner end and a second outer end, said first inner end and said second inner end being removably secured to one another at a first joint, said first outer end and said second outer end being secured to respective said first and second said rail members, wherein said first and second segments are detached from one another while said frame is in its disassembled state, and said first and second segments are attached to one another while said frame is in its assembled state.

2. The boat lift of claim 1 including a first pivot hinge for pivotally connecting said first outer end to said first rail member and a second pivot hinge for pivotally connecting said second outer end to said second rail member, wherein said first segment is pivotable between a first position generally perpendicular to said first rail and a second position generally parallel to said first rail while said frame is in its disassembled state, and said second segment is pivotable between a third position generally perpendicular to said second rail and a fourth position generally parallel to said second rail while said frame is in its disassembled state.

3. A collapsible boat lift, comprising:

a first siderail and a second siderail;

a dual-segmented front brace member extending between said first and second siderails and having a first end and a second end, said front brace member including a first removable joint for selectively connecting and disconnecting from one another each said segment of said front brace member;

a first pivot hinge pivotally securing said first end to said first siderail, and a second pivot hinge for pivotally securing said second end to said second siderail;

a rear brace member extending between said first and second said siderails and having a third end and a fourth end;

a first removable hinge for removably securing said third end to said first siderail, and a second removable hinge for removably securing said fourth end to said second siderail; and a carriage for supporting a boat, said carriage being supported on said first and second siderails and being movable thereon between a lowered position and an elevated position.

4. A method of disassembling a boat lift, comprising the steps of:

lifting a carriage off of a rigid frame;

removing a first pin from a first joint that secures a first end of a first brace member to a first siderail;

removing a second pin from a second joint that secures a second end of said first brace member to a second siderail, thereby permitting said first brace member to be moved separate and away from said siderails;

removing a third pin from a second brace member extending between said siderails and having a first segment that is pivotally attached to said first siderail and a second segment that is pivotally attached to a second siderail, said third pin securing said first segment to said second segment, whereupon said removal of said third pin permits said first and second segments to pivot about said respective siderails; and folding said first and second segments toward said respective first and second siderails.

* * * * *